US009241512B2

(12) United States Patent
Lemmouchi

(10) Patent No.: US 9,241,512 B2
(45) Date of Patent: Jan. 26, 2016

(54) FILTER MATERIAL COMPRISING POLYLACTIDE FIBRES

(75) Inventor: Yahia Lemmouchi, London (GB)

(73) Assignee: BRITISH AMERICAN TOBACCO (INVESTMENTS) LIMITED (GB)

( * ) Notice: Subject to any disclaimer, the term of this patent is extended or adjusted under 35 U.S.C. 154(b) by 3 days.

(21) Appl. No.: 14/128,914

(22) PCT Filed: Jun. 22, 2012

(86) PCT No.: PCT/GB2012/051451

§ 371 (c)(1),
(2), (4) Date: Jan. 31, 2014

(87) PCT Pub. No.: WO2012/175979

PCT Pub. Date: Dec. 27, 2012

(65) Prior Publication Data

US 2014/0190505 A1 Jul. 10, 2014

(30) Foreign Application Priority Data

Jun. 23, 2011 (GB) ..... 1110669.7
Jul. 1, 2011 (GB) ..... 1111254.7

(51) Int. Cl.
*A24D 3/06* (2006.01)
*A24D 3/08* (2006.01)
*A24D 3/14* (2006.01)

(52) U.S. Cl.
CPC . *A24D 3/08* (2013.01); *A24D 3/068* (2013.01)

(58) Field of Classification Search
USPC ..... 131/331, 332, 341, 343
See application file for complete search history.

(56) References Cited

U.S. PATENT DOCUMENTS

| | | | | |
|---|---|---|---|---|
| 5,817,728 | A | 10/1998 | Higuchi et al. | |
| 5,914,381 | A | 6/1999 | Terado et al. | |
| 6,062,228 | A | 5/2000 | Loercks et al. | |
| 8,613,284 | B2 | 12/2013 | Hutchens | |
| 2003/0173418 | A1 | 9/2003 | Koborinai et al. | |
| 2006/0124145 | A1 | 6/2006 | Schmidt | |
| 2009/0288669 | A1* | 11/2009 | Hutchens | 131/274 |
| 2010/0203130 | A1 | 8/2010 | Tygesen et al. | |
| 2011/0036366 | A1 | 2/2011 | Sebastian | |
| 2012/0000479 | A1* | 1/2012 | Sebastian et al. | 131/332 |

(Continued)

FOREIGN PATENT DOCUMENTS

| | | | |
|---|---|---|---|
| CN | 101400363 A | | 1/2007 |
| CN | 101023811 A | * | 8/2007 |
| CN | 101781467 A | | 1/2010 |

(Continued)

OTHER PUBLICATIONS

CN 101023811 A Claims, Machine translation, European Patent Office, [online], Retrieved from the Internet, [retrieved Feb. 19, 2015], <URL: http://translationportal.epo.org/emtp/translate/?ACTION=claims-retrieval&COUNTRY=CN&ENGINE=google&FORMAT=docdb&KIND=A&LOCALE=en_EP&NUMBER=101023811&OPS=cn.espacenet.com/ops&SRCLANG=zh&TRGLANG=en>.*

(Continued)

*Primary Examiner* — Dennis Cordray
(74) *Attorney, Agent, or Firm* — Cantor Colburn LLP

(57) ABSTRACT

The invention relates to filter material for inclusion in the filter or filter element of a 5 smoking article, said filter material comprising polylactide fibers and a plasticizer. The invention also relates to filters or filter elements comprising the filter material, and smoking articles comprising the same.

6 Claims, 6 Drawing Sheets

(56) References Cited

U.S. PATENT DOCUMENTS

| | | | | |
|---|---|---|---|---|
| 2012/0000480 | A1* | 1/2012 | Sebastian et al. | 131/332 |
| 2014/0318561 | A1* | 10/2014 | Lemmouchi et al. | 131/332 |

FOREIGN PATENT DOCUMENTS

| | | | |
|---|---|---|---|
| CN | 102080275 | A | 6/2011 |
| CN | 102080278 | A | 6/2011 |
| DE | 69309701 | T3 | 9/1993 |
| EP | 697427 | B1 | 7/1995 |
| EP | 1567025 | B1 | 10/2003 |
| JP | 7-76632 | A | 3/1995 |
| JP | 11056995 | A | 8/1997 |
| JP | 9-266783 | A | 10/1997 |
| JP | 04565944 | B2 | 9/2004 |
| JP | 04613575 | B2 | 10/2004 |
| JP | 04661345 | B2 | 5/2005 |
| JP | 2009545307 | A | 12/2009 |
| JP | 2010255173 | A | 4/2010 |
| JP | 2011032629 | A | 9/2010 |
| KR | 912698 | B1 | 1/2008 |
| WO | 02/17738 | A1 | 3/2002 |
| WO | 2008/015573 | A2 | 2/2008 |
| WO | 2009139508 | A1 | 5/2009 |
| WO | 2010/098933 | A1 | 9/2010 |
| WO | 2011019646 | A1 | 2/2011 |
| WO | 2011063628 | A1 | 6/2011 |
| WO | 2011063632 | A1 | 6/2011 |
| WO | 2012012053 | A1 | 1/2012 |

OTHER PUBLICATIONS

CN 101023811 A Description, Machine translation, European Patent Office, [online], Retrieved from the Internet, [retrieved Feb. 19, 2015], <URL:http://translationportal.epo.org/emtp/translate/?ACTION=description-retrieval&COUNTRY=CN&ENGINE=google&FORMAT=docdb&KIND=A& LOCALE=en_EP&NUMBER=101023811&OPS=cn.espacenet.com/ops&SRCLANG=zh&TRGLANG=en.*

International Search Report and Written Opinion, mailed Aug. 24, 2012, for International Patent Application PCT/GB2012/051451, filed Jun. 22, 2012.

International Preliminary Report on Patentability, mailed Nov. 7, 2013, for International Patent Application PCT/GB2012/051451, filed Jun. 22, 2012.

Office Action, dated Apr. 7, 2015, for JP 2014-516443, referencing JP 2009-545307, JP 7-76632, JP 9-266783, WO 02/017738 and WO 2010/098933 (copies attached, machine translations for non-English references and Office Action).

English Translation of First Office Action, issued May 26, 2015, for corresponding Chinese Patent Application No. 201280030827.6, filed Jun. 22, 2012.

English Translation of the State Intellectual Property Office of People's Republic of China Search Report, issued May 26, 2015, for corresponding Chinese Patent Application No. 201280030827.6, filed Jun. 22, 2012.

* cited by examiner

FILTER MATERIAL COMPRISING POLYLACTIDE FIBRES

CLAIM FOR PRIORITY

This application is a National Stage Entry entitled to and hereby claiming priority under 35 U.S.C. §§365 and 371 to corresponding PCT Application No. PCT/GB2012/051451 filed Jun. 22, 2012, which in turn claims priority to British Patent Application No. GB1110669.7, filed Jun. 23, 2011 and which also claims priority to British Patent Application No, GB1111254.7, filed Jul. 1, 2011. The entire contents of the aforementioned applications are herein expressly incorporated by reference.

FIELD

The present invention relates to filter materials for use in the filters or filter elements of smoking articles, the materials comprising polylactide fibres and one or more plasticizers.

BACKGROUND

A wide variety of fibrous materials have been suggested as filters for cigarette smoke. Cellulose acetate tow is the most commonly used filter material. One disadvantage associated with this filter material is, however, that it is slow to degrade. Whilst most of the components of a spent smoking article dissociate into their individual constituent parts and degrade within a relatively short period of time when exposed to moisture and/or mechanical abrasion, cellulose acetate filter material is slow to degrade because the cellulose acetate fibres themselves are effectively not water soluble and therefore poorly biodegradable.

For disposable products, it is desirable to use materials which are biodegradable. Biodegradable polymers disposed of in bioactive environments degrade by the enzymatic action of microorganisms such as bacteria, fungi and algae. Their polymer chains may also be cleaved by non-enzymatic processes such as chemical hydrolysis. As used herein, the term "biodegradable" means that the composition degrades within one year using the standard test method for determining aerobic biodegradation of plastic materials under controlled composting conditions.

Poly(lactic acid) or polylactide (PLA), is an attractive biodegradable and biocompatible polymer. It is derived from renewable resources (e.g., corn, wheat, or rice) and it is biodegradable, recyclable, and compostable. In addition, PLA exhibits excellent processability. Actually, PLA has better thermal processability compared to other biodegradable materials such as poly(hydroxyalkanoates) (PHAs), poly(68-caprolactone) (PCL), etc. It can be processed by injection moulding, film extrusion, blow moulding, thermoforming, fibre spinning, and film forming. However, the use of PLA can be restricted due to the fact that it is a hydrophobic polymer and is not able to solubilise or disperse in water.

It is desirable to produce biodegradable filter materials, preferably are made from materials which can be easily processed to produce fibres, which are thermally processable and which have good mechanical and physical properties.

CA may be treated with plasticizers for use in smoking article filters. This involves applying the plasticizer (usually in liquid form) to the surface of the CA fibres, for example by spraying the liquid plasticizer on to the CA tow. The plasticizer acts by binding adjacent fibres to one another at their contact points, thereby affording the filter rods sufficient hardness for cigarette manufacture and use. Thus, although the materials added to CA in this way are generally referred to as plasticizers, they are really acting as binders or hardeners rather than as plasticizers. Suitable plasticizers for this use include triacetin (glycerin triacetate), TEC (triethyl citrate) and PEG 400 (low molecular weight polyethylene glycol). Plasticized cellulose acetate tow is also known to improve the selective removal of semi-volatile compounds found in smoke (e.g. phenol, o-cresol, p-cresol and m-cresol). For this effect, it is considered to be necessary for the plasticizer to be present on the surface of the CA fibres. Unfortunately, the addition of a plasticizer which binds fibres actually can result in a reduction in the degradability of the filter material. The binding of the fibres certainly slows the separation of the individual fibres making up the tow in a spent smoking article, thus maintaining the bundle of fibres and reducing their exposure to the elements that will carry out any degradation process.

Because of the fibre-binding effect of plasticizers, conventional CA filters often include between 6 and 8% plasticizer. It has been found that including plasticizer in greater amounts than this has a detrimental effect on the cellulose acetate tow, causing holes to be formed.

SUMMARY

According to a first aspect of the present invention, a filter material for inclusion in the filter or filter element of a smoking article is provided, said filter material comprising polylactide fibres and at least one plasticizer.

In a second aspect of the present invention, filters and filter elements are provided, comprising the filter material according to the first aspect.

In third aspect of the present invention, smoking articles are provided, comprising the filter or filter elements according to the second aspect.

DETAILED DESCRIPTION

Embodiments of the invention may provide filter materials with good mechanical properties, such as strength and good processability, whilst also or alternatively being biodegradable and/or providing excellent adsorption characteristics when incorporated into a filter or filter element of a smoking article.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products.

The fibres of the filter material may consist essentially of polylactide fibres. Additionally or alternatively, the polylactide fibres may consist essentially of polylactide.

The fibres may be manufactured from PLA in much the same way as CA fibres are manufactured from CA. The CA fibres are manufactured using solvent spinning process but PLA fibres may be produced using melt extrusion process.

The polylactide (PLA) used in the present invention may be produced by different synthetic methods, such as ring-opening polymerization of lactide or direct condensation polymerization from lactic acid. Any PLA grade can be selected for use in this invention, and the molecular weights of the PLA may vary depending on the desired properties and use. Poly(L-lactide) (PLLA) is preferred due to its crystallinity, which is beneficial for the production of fibres.

Figure 1:
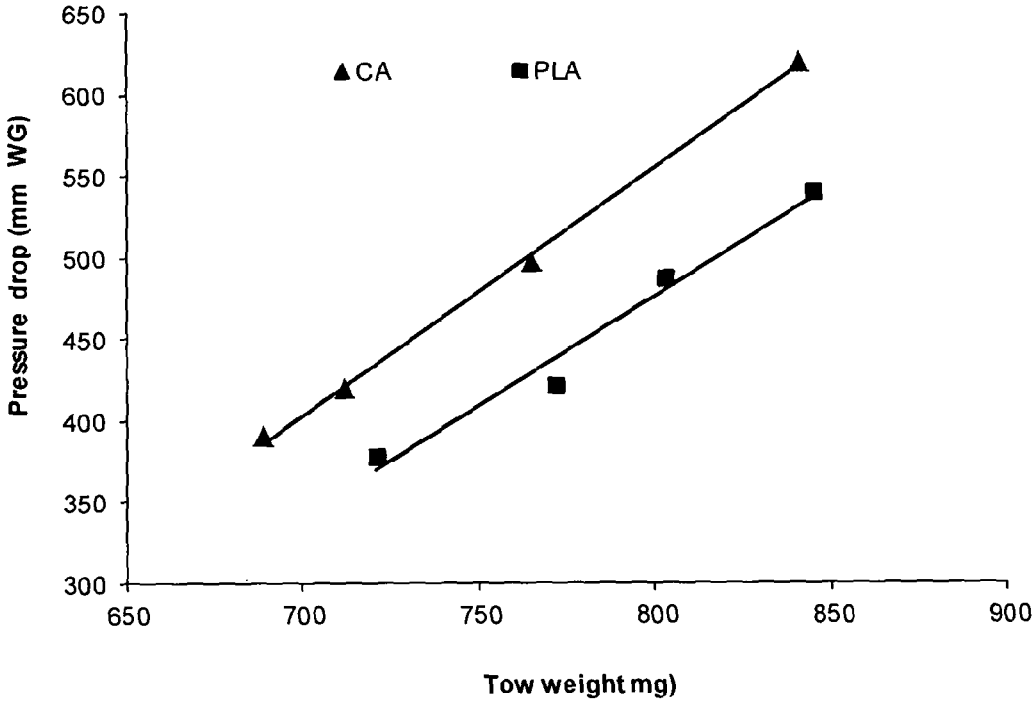
FIG. 1 shows capability curve plots of PLA tow and CA tow.

FIG. 1 shows capability curve plots of PLA tow and CA tow, with tow characteristics 3Y40000. The capability curve of FIG. 1 indicates the variation of the filter pressure drop as a function of tow weight used in the filter. The results given are for a filter rod of 132 mm length and 24.30 mm circumference. This information allows one to adjust the weight of the filter in order to achieve the desired pressure drop, which may be to match that of a conventional cellulose acetate filter. The capability curve can also provide the limits of the tow processability (highest and lowest pressure drop).

Figure 2:
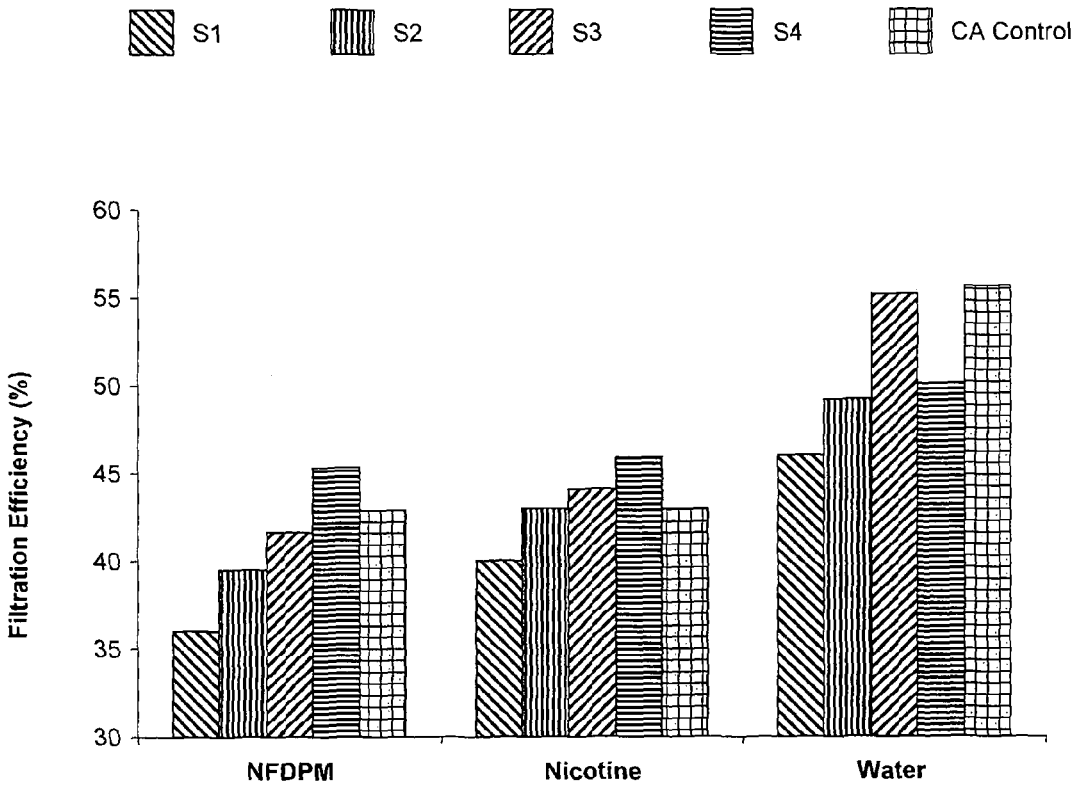
FIG. 2 provides a graph showing the filtration efficiency of a PLA filter as a function of pressure drop.

FIG. 2 shows the filtration efficiency of PLA filter as a function of pressure drop. S1-4 are the samples from Table 1. The smoke analysis was carried out under ISO regime (35/2/60) with the ventilation zone blocked. As indicated by the data provided in FIG. 2, the adsorption characteristics of a filter made from PLA fibres alone were relatively poor compared to a conventional plasticized cellulose acetate filter (with 8.6% plasticizer) at the same pressure drop. In the graph, four samples of filters made using the unplasticized PLA tow were tested, based upon the pressure drop of these filters (377, 421, 486, 540 mm water gauge respectively, filter rod length=132 mm). As discussed in greater detail below, the pressure drop of these samples is related to the weight of PLA (see Table 1).

Figure 3:
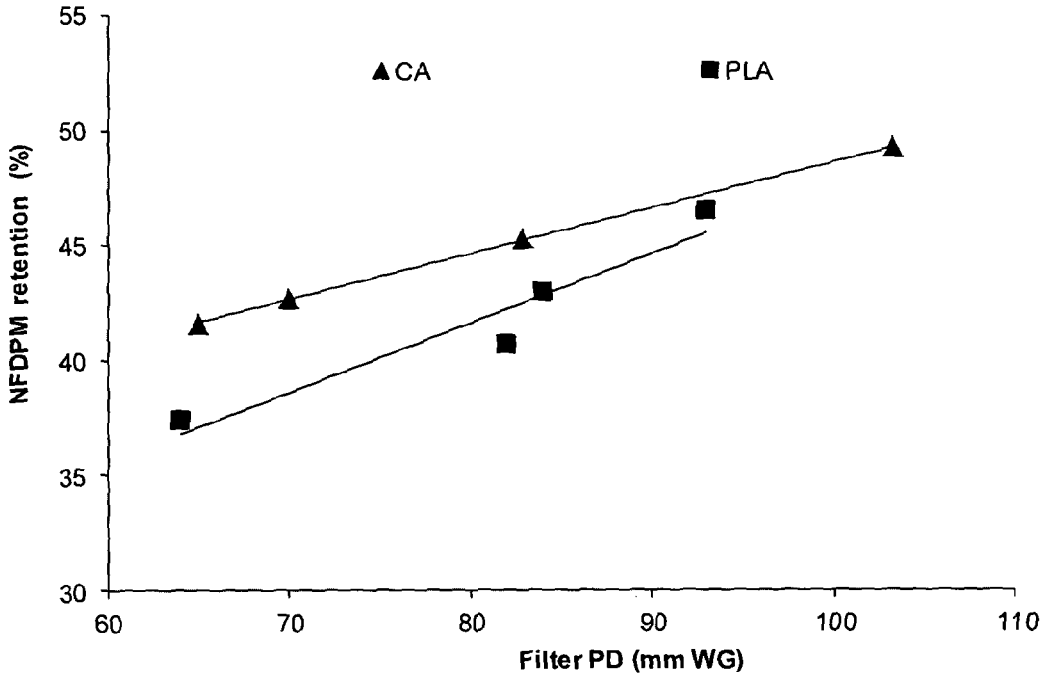
FIG. 3 provides a graph showing the NFDM filtration efficiency vs pressure drop for PLA tow and CA tow.

FIG. 3 shows the NFDM filtration efficiency vs pressure drop for filters made from PLA tow and CA tow. The filters (having a length of 22 mm and a circumference of 24.3 mm) were made from tows of the same specification (3.0Y40000). The smoke analysis was carried out under ISO regime (35/2/60) with the ventilation zone blocked.

As mentioned above, the plasticizer included in the CA tow is acting as a binder, causing adjacent fibres to become adhered to one another, thereby increasing the hardness and structural integrity of the tow. In contrast, when the same plasticizers are added to PLA fibres, they act as true plasticizers, providing a softening effect, and they do not cause binding between fibres.

However, it has been found that the addition of at least one plasticizer to the PLA fibres has a significant effect in the adsorption characteristics of the tow.

Figure 4:
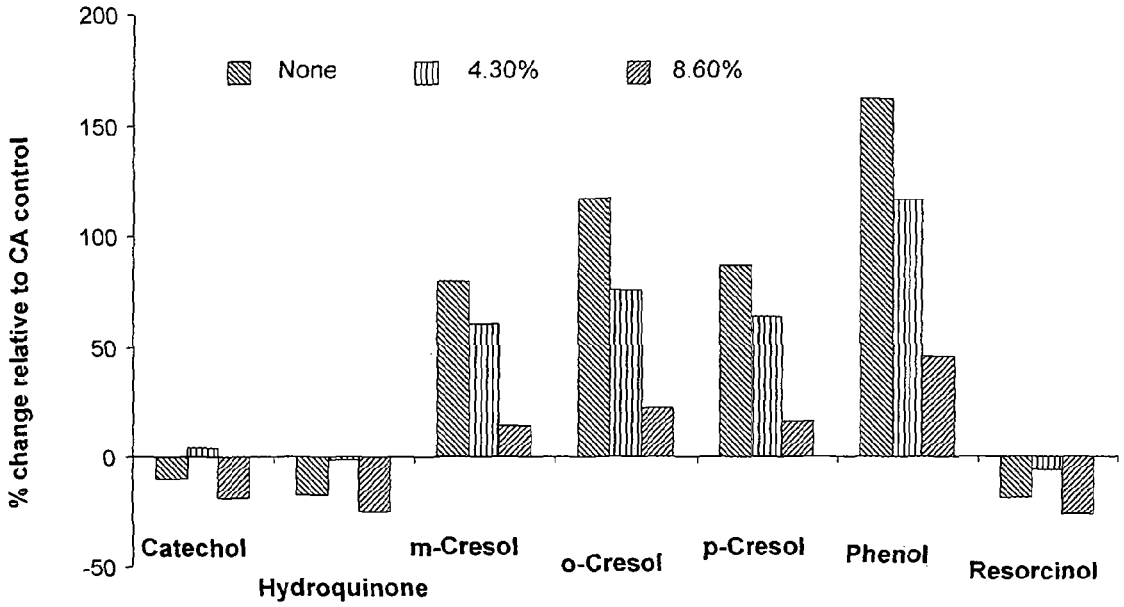
FIG. 4 provides a graph showing the effect of triacetin (TA) used as additive in the PLA filter on the adsorption of phenolic compounds in smoke.
Figure 5:
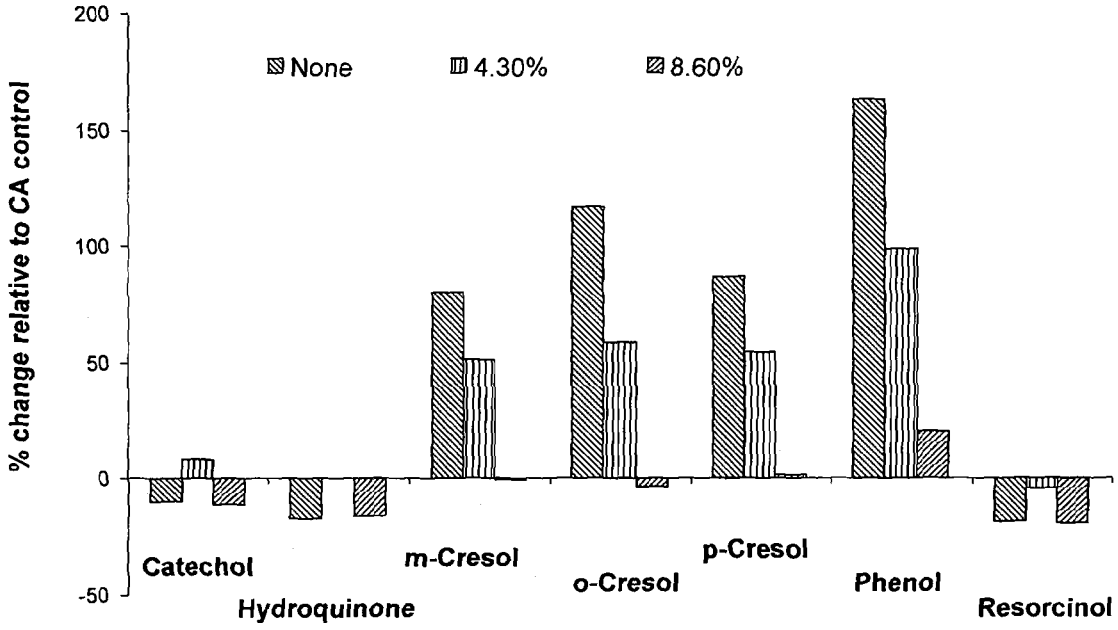
FIG. 5 provides a graph showing the effect of triethyl citrate (TEC) used as additive in the PLA filter on the adsorption of phenolic compounds in smoke.
Figure 6:
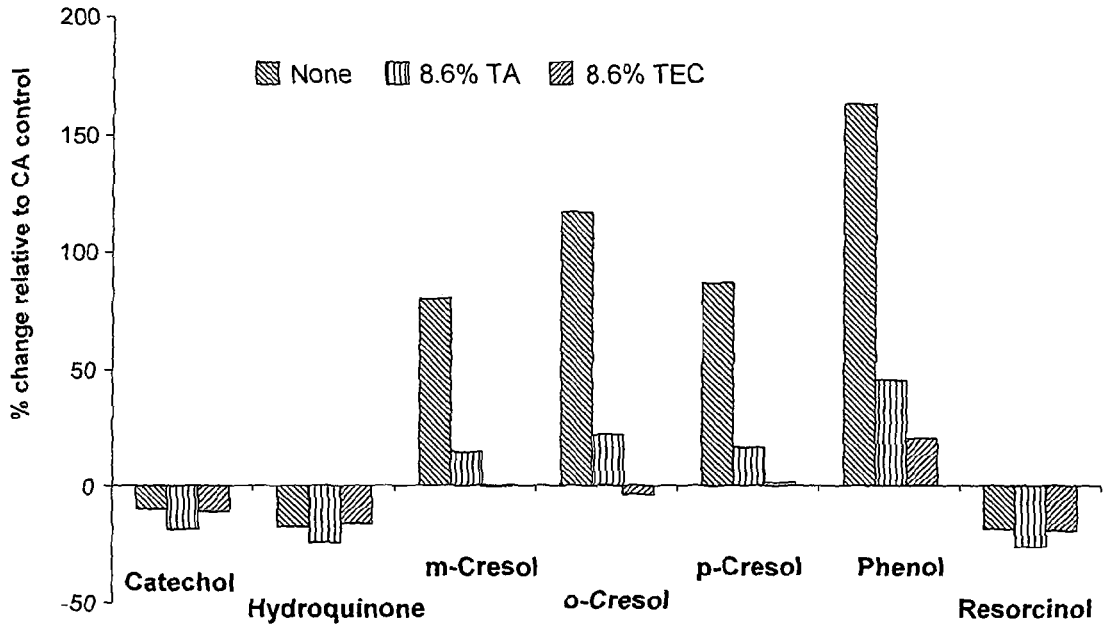
FIG. 6 provides a graph showing the effect of different additives in PLA filter on the adsorption of phenolic compounds in smoke.

As can be seen from the data in FIGS. 4 to 6, PLA tow with no plasticizer shows relatively poor adsorption of a number of Hoffmann Analytes, especially when looking at phenolic analytes. A measure of 0% in these graphs indicates that the PLA-based tow has matched the performance of the conventional plasticized CA tow which is used as the control (referred to as "CA control" in the graphs).

It is clear that for some analytes, the adsorption of CA is approximated, achieved or even, in some cases, bettered by adding a plasticizer. Where the graph shows a negative percentage figure, adsorption was better than that of the CA control.

In some embodiments, the filter material includes one or more plasticizers selected from the group consisting of PEG, triacetin and TEC.

The total amount of plasticizer included in the filter material may be between 4 and 15% by weight of the total filter tow material. Thus, if a single plasticizer is used, it may be included in an amount from 4 to 15% by weight. If a combination of plasticizers is used, their combined amount should be 4 to 15% by weight of the filter tow material.

In some embodiments, the filter materials may provide an increase in the selective removal of semi-volatile compounds from the smoke being drawn through the filter material. It is believed that the use of polyethylene glycol, TEC and/or triacetin as a plasticizer applied to the surface of the PLA fibres may contribute to this effect.

In some embodiments, the filter materials may provide improved taste characteristics of the smoke drawn through the filter material. In some implementations, the use of TEC and/or triacetin as a plasticizer applied to the surface of the PLA fibres may contribute to this effect.

EXAMPLES

The present invention is illustrated in greater detail by the following specific Examples. It is to be understood that these Examples are illustrative embodiments and that this invention is not to be limited by any of the Examples.

The PLA tow used was designated 3.0Y40000, which means that the PLA filament denier was 3.0, the fibre shape was Y, and the tow denier was 40,000.

Processing was done using a KDF2 machine, which is a machine used to convert the tow into filter rods.

Table 1 below shows the variation in pressure drop when compared to tow weight for PLA and CA filter tow, when incorporated into a standard filter rod with a length of 132 mm and a diameter of 24.30 mm. The different samples were made from the same PLA tow by varying the tow weight in the filter rod, that is, by different degrees of packing so that varying amounts of PLA tow was included in filters of the same dimensions.

TABLE 1

Variation of pressure drop (PD) vs. tow weight. Filter rod length = 132 mm, Circumference = 24.30 mm

| | Weight (mg) | PD (mm WG) |
|---|---|---|
| Sample 1 (S1) | 721 | 377 |
| Sample 2 (S2) | 772 | 421 |
| Sample 3 (S3) | 803 | 486 |
| Sample 4 (S4) | 845 | 540 |

FIG. 2 provides a graph showing the filtration efficiency of a PLA filter as a function of pressure drop. The smoke analyses were carried out under ISO smoking regime (35/2/60) with the ventilation zone blocked.

FIG. 2 shows the filtration efficiency of the PLA filters mentioned in Table 1. The filtration efficiency expresses how efficient the filter is at retaining the listed smoke components. This is measured by smoking a control cigarette without filter and test cigarettes with PLA filters and measuring the amount tar (NFDPM), nicotine and water delivered in both cases. The results show that the delivery can be adjusted by varying the filter pressure drop.

FIG. 4 provides a graph showing the effect of triacetin (TA) used as additive in the PLA filter on phenolic compounds in the smoke. The smoke analyses were carried out under ISO regime smoking (35/2/60) with the ventilation zone blocked.

The results are normalised to tar and expressed as a percentage difference with CA. The data show a comparison between the phenolic compounds delivery using PLA with different amounts of TA. A conventional cigarette with a plasticized CA filter (the pCA control) was used as the baseline. The results are expressed as a percentage calculated as follows:

$$(\text{Delivery from PLA}-\text{Delivery from control})\times 100/\text{Delivery from control}$$

The results show a decrease of the analytes with increasing the amount of TA.

FIG. 5 provides a graph showing the effect of triethyl citrate (TEC) used as additive in the PLA filter on phenolic compounds in the smoke. The smoke analyses were carried out under ISO regime smoking (35/2/60) with the ventilation zone blocked. The results are normalised to tar and expressed as a percentage difference with CA control. The data was calculated in the same manner as set out above in connection with FIG. 4. The results show that the addition of TEC to the PLA fibres has the effect of increasing the selective adsorption of analytes.

FIG. 6 provides a graph showing the effect of different additives in PLA filter on phenolic compounds in the smoke. The smoke analyses were carried out under ISO regime smoking (35/2/60) with the ventilation zone blocked. The results are normalised to tar and expressed as a percentage difference with CA control. The data was calculated in the same manner as set out above in connection with FIG. 4. The results show that the addition of TEC to the PLA fibres has a greater effect on the selective adsorption of analytes than the addition of the same amount of triacetin.

Thus, this data allows us to conclude that the use additives in PLA filter may enhance the selective removal of certain Hoffmann analytes.

In order to address various issues and advance the art, the entirety of this disclosure shows by way of illustration various embodiments in which the claimed invention may be practiced and provide for superior filter material. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A filter material for inclusion in a filter or filter element of a smoking article, said filter material comprising polylactide fibres and a plasticizer, wherein the polylactide fibres consist essentially of polylactide, and the polylactide fibres are not hound to each other by the plasticizer.

2. A filter material as claimed in claim 1, polylactide fibres consist of polylactidc.

3. A filter material as claimed in claim 1, wherein the plasticizer is selected from the group consisting of polyethylene glycol, triacetin and TEC.

4. A filter material as claimed in claim 1, wherein the plasticizer is included in an amount of 4 to 15% by weight of the filter material.

5. A filter element comprising a filter material comprising polylactide fibres and a plasticizer, wherein the polylactidc fibres consist essentially of polylactide, and the polylactide fibres are not bound to each other by the plasticizer.

6. A smoking article comprising a filter element comprising polylactide fibres and a plasticizer, wherein the polylactide fibres consist essentially of polylactide, and the polylactide fibres are not bound to each other by the plasticizer.

* * * * *